United States Patent [19]

Inoue et al.

[11] 3,978,750

[45] Sept. 7, 1976

[54] APPARATUS FOR ADJUSTING A FREQUENCY OF AN OSCILLATING ELEMENT PROVIDED A HAIR SPRING

[75] Inventors: Souichi Inoue, Yokohama; Katsumi Kato, Tokyo; Yoshiharu Marumo, Matsudo, all of Japan

[73] Assignee: Kabushiki Kaisha Seikosha, Japan

[22] Filed: June 18, 1975

[21] Appl. No.: 587,872

[30] Foreign Application Priority Data

June 18, 1974 Japan ..... 49-69499

[52] U.S. Cl. ..... 83/208

[51] Int. Cl.[2] ..... B26D 5/20

[58] Field of Search ..... 83/72, 208

[56] References Cited

UNITED STATES PATENTS

| | | | |
|---|---|---|---|
| 3,406,601 | 10/1968 | Clifford | 83/208 X |
| 3,707,255 | 12/1972 | Ridgway et al. | 83/208 X |
| 3,760,669 | 9/1973 | Rosenthal et al. | 83/208 X |

*Primary Examiner*—Willie G. Abercrombie
*Attorney, Agent, or Firm*—Robert E. Burns; Emmanuel J. Lobato; Bruce L. Adams

[57] ABSTRACT

An apparatus for adjusting the frequency of an oscillating element provided with a hair sp extracts an oscillating signal from the oscillating element which is oscillated by the elastic force of the hair spring. High frequency pulses are counted by a counter during a predetermined period of the oscillation signal. On the other hand, further high frequency pulses are counted by another counter. When the count value of the latter counter coincides with that of the former counter, the input pulses to the latter counter are stopped by the coincidence output. Until the coincidence between the count values of both the counters is established, the hair spring is transported to adjust the length thereof. Thereafter, the unnecessary hair spring is cut away. Since this apparatus detects an appropriate length of the hair spring by electronic circuitry, it is small in size, and the unnecessary length of hair spring is automatically cut away.

2 Claims, 13 Drawing Figures

APPARATUS FOR ADJUSTING A FREQUENCY OF AN OSCILLATING ELEMENT PROVIDED A HAIR SPRING

BACKGROUND OF THE INVENTION

The present invention relates to apparatus for adjusting a hair spring in which an appropriate length of the hair spring provided as part of an oscillating element is detected by electronic circuitry and in which the rest of the hair spring is automatically cut away.

One known type of apparatus for adjusting the frequency of, e.g., a balance wheel and for cutting a hair spring thereof, is described below. The oscillation output of the balance wheel is taken out, and the frequency is multiplied to drive a motor. On the other hand, an output frequency from a crystal oscillator is divided to a predetermined frequency, applied to drive another motor. Both the motors cause differential gears to rotate. The hair spring is conveyed in accordance with the rotation of a disc which is fixed to a shaft of the differential gears. When the numbers of revolutions of the motors coincide, an operator confirms the stop of the disc, and a switch of a cutting device is actuated by the operator to cut the hair spring. However, the apparatus is disadvantageous in that the operator need always confirm the stop of the disc. Besides, the mechanical structure occupies a large part of the apparatus and the two motors are included, so that the whole construction of the apparatus is large-sized.

SUMMARY OF THE INVENTION

The present invention overcomes the above-mentioned difficulties and provides a newly improved apparatus for adjusting the frequency of an oscillating element provided with a hair spring.

One of the features of this invention resides in apparatus for adjusting the frequency of an oscillating element provided with a hair spring, comprising a converter circuit which converts into predetermined signal pulses a vibration output signal of the oscillating element having its vibration period determined by the hair spring, a first control circuit which controls passage of clock pulses by the output pulses of the converter circuit, a first counter which counts the clock pulses having passed through the first control circuit, a second control circuit which controls passage of reference pulses, a second counter which counts the reference pulses having passed through the second control circuit, a coincidence circuit which detects the coincidence between count contents of the first counter and the second counter, first means to control the second control circuit by the coincidence output and to check the reference pulses to the second counter, and mechanical means to transport the hair spring during the counting operation of the second counter and to cut away an unnecessary part of the hair spring after the first counter has counted a predetermined value.

An object of the present invention is to provide apparatus which automatically performs all the jobs from the adjustment of the hair spring of the oscillating element to the cutting thereof.

Another object of the present invention is to provide apparatus which is very small in size and is accordingly portable and which makes it unnecessary for the operator to watch the cutting of the hair spring and is accordingly high in the operation efficiency.

BRIEF DESCRIPTION OF THE DRAWING

The nature of the present invention as well as other objects and advantages thereof will become more apparent from consideration of the following detailed description and the accompanying drawing in which:

FIGS. 1 to 3 show a mechanical construction of an embodiment of the present invention, in which FIG. 1 is a plan view thereof, FIG. 2 is a sectional view taken along line II — II in FIG. 1, and FIG. 3 is a fragmentary sectional view.

DESCRIPTION OF THE EMBODIMENT

Figure 1:
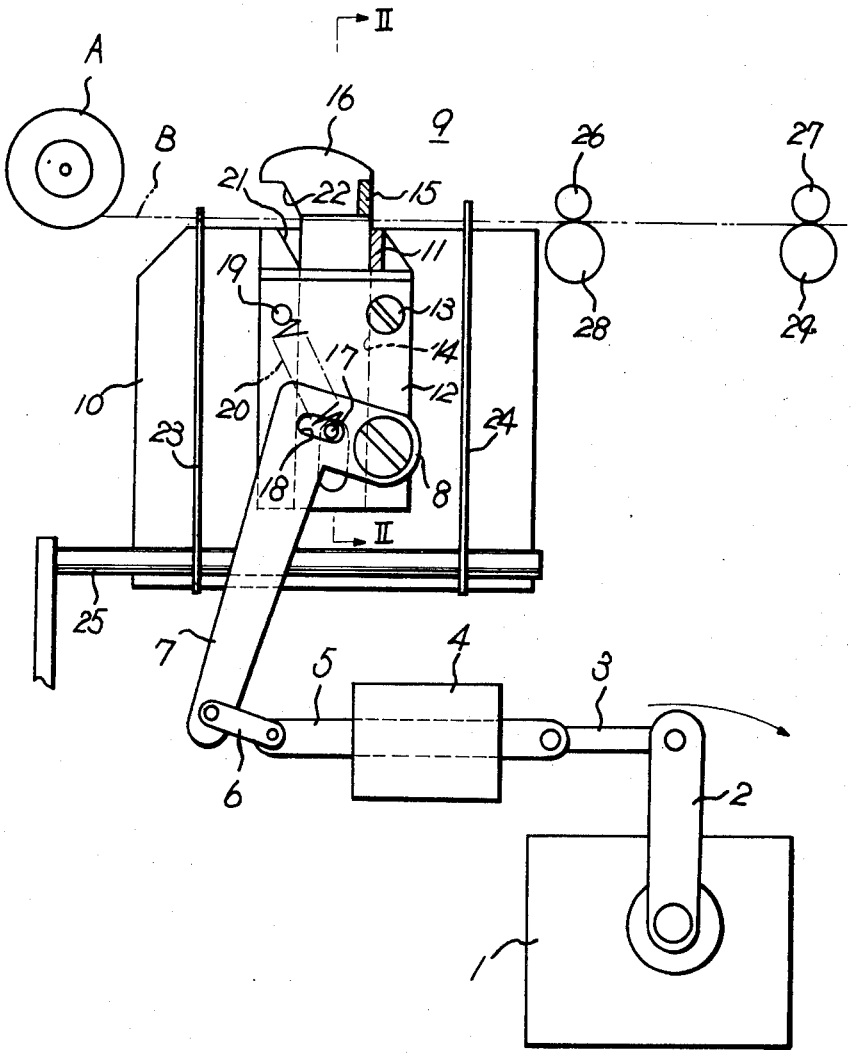

Hereunder an embodiment of the present invention will be described in conjunction with the drawing. In the embodiment, there will be treated a case where the daily rate of a balance wheel before adjusting does not exceed 6,000 seconds and oscillation period thereof is adjusted to 0.4 second.

A mechanical construction of the present invention will be first explained with reference to FIGS. 1 and 2.

Figure 2:
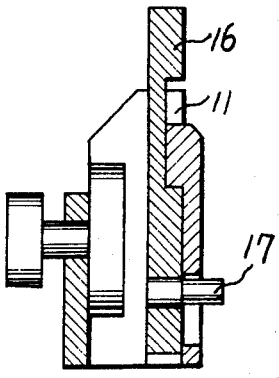

In FIG. 1, a rotary solenoid 1 has a driving arm 2 to which a coupling piece 3 is turnably attached. A rod 5 journaled in a bearing 4 is connected to the coupling piece 3, while it is connected through a coupling piece 6 to a swivel lever 7. The swivel lever 7 rocks about a shaft 8, and actuates a cutting device 9. The cutting device 9 is constructed as will now be stated.

A bed plate 12 provided with a fixed cutting edge 11 is secured on a base 10 by a screw 13 etc. At a middle part of the bed plate 12, a guide slot 14 is longitudinally formed. A slide plate 16 having a movable cutting edge 15 is slidably fitted in the guide slot 14.

The slide plate 16 is protrusively provided with a pin 17, which is engaged with a groove 18 formed in the swivel lever 7. A spring 20 is retained between the pin 17 and a pin 19 protuberantly provided on the bed plate 12, so that a turning effort is normally bestowed on the swivel lever 7 clockwise as viewed in FIG. 1. The bed plate 12 is formed with an inclined plane 21 at its position opposite to the fixed cutting edge 11, while the slide plate 16 is formed with an inclined side 22 registering with the inclined plane 22.

At both side parts of the base 10, levers 23 and 24 for removing a hair spring are disposed in such manner that their lower ends are secured to a rotary handle 25.

Accordingly, the hair spring B drawn out from the balance wheel A rotatably held beside the base 10 is supported by the lever 23 and passes between the movable cutting edge 15 and the fixed cutting edge 11. Further, it is guided by the lever 24. Under such state, it is pulled out rightwards in FIG. 1 by means of two driving rollers 26 and 27 and two pressed contact rollers 28 and 29.

Figure 3:
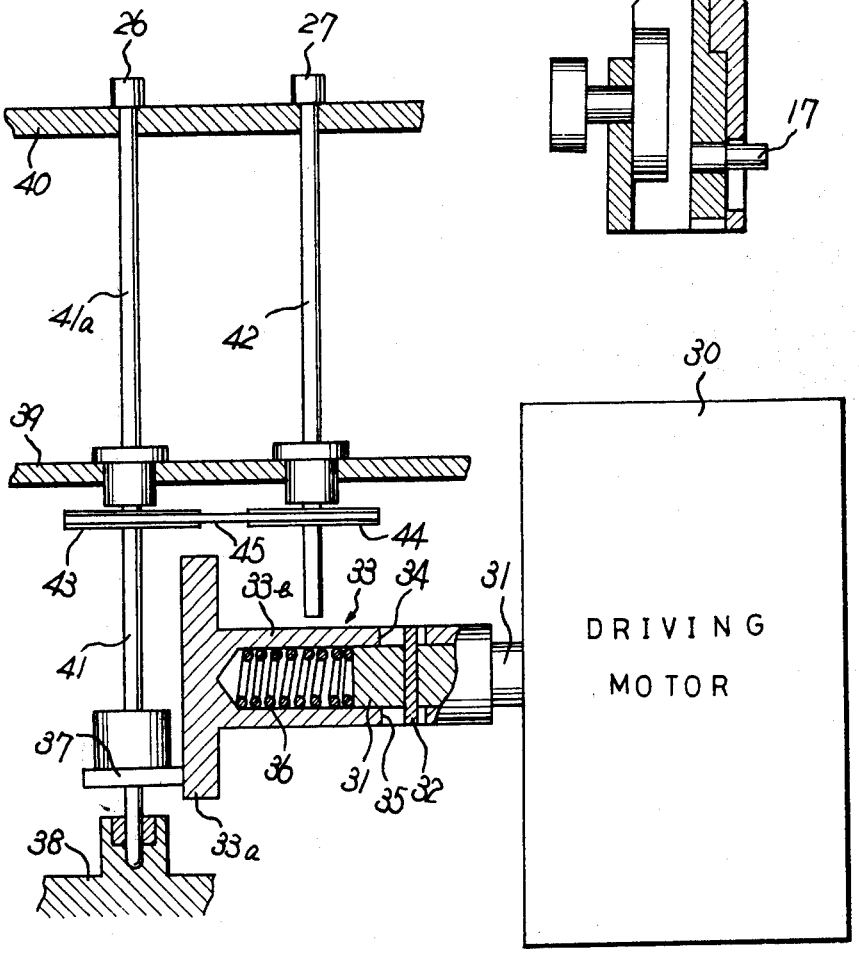

Referring now to FIG. 3, a drive mechanism of the driving rollers 26 and 27 will be explained.

A knock pin 32 is mounted on a driving shaft 31 of a driving motor 30 in a manner to penetrate through an axis thereof. A rotary member 33 having a rotary disc **33*a* and a hollow cylinder 33*b* is formed with grooves 34 and 35** at symmetric positions of the hollow cylinder 33*b*. The pin 32 is engaged with these grooves. A spring 36 is inserted in a hollow portion of the hollow cylinder 33*b*, so that a spring force is normally bestowed on the rotary member 33 leftwards as viewed in FIG. 3. A rotor 37 made of rubber is held in pressed contact with a front surface of the rotary disc 33*a*. The rotor 37 is mounted on a shaft 41 which is supported by a bearing 38 and a base plate 39. A shaft 41*a* coupled to the shaft 41 is supported between the base plate 39 and another base plate 40. A shaft 42 is also supported between the base plates 39 and 40. A belt 45 is extended over pulleys 43 and 44 which are respectively mounted on the shafts 41 and 42. At extreme ends of the shafts 41*a* and 42, the driving rollers 26 and 27 are mounted.

Figure 4:
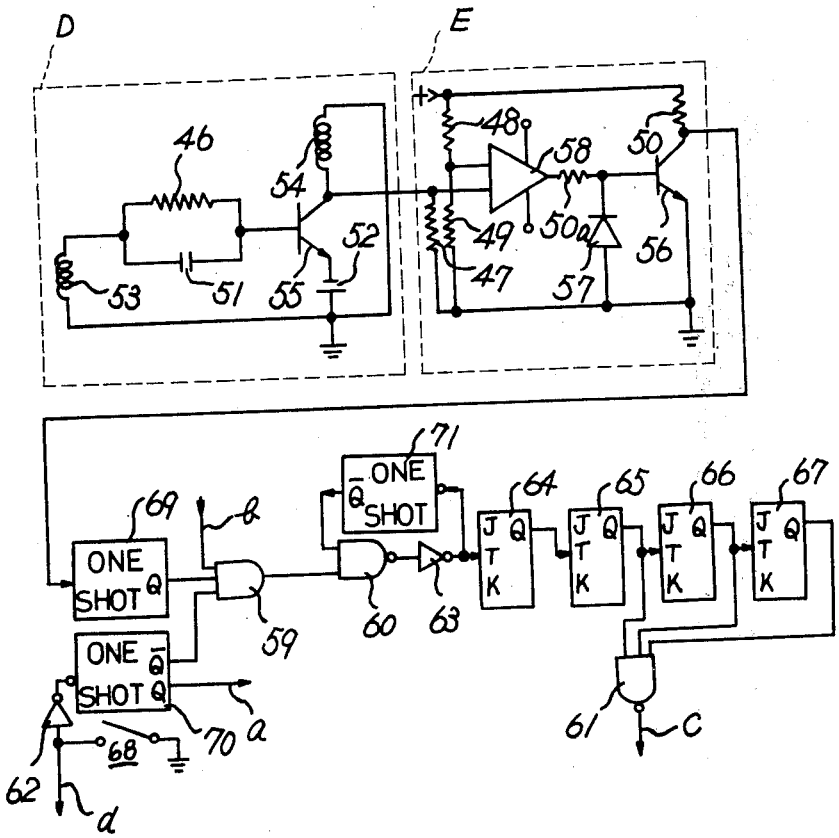
FIG. 4 and FIGS. 5A and 5B show an electronic circuit arrangement of the embodiment.
Figure 5:
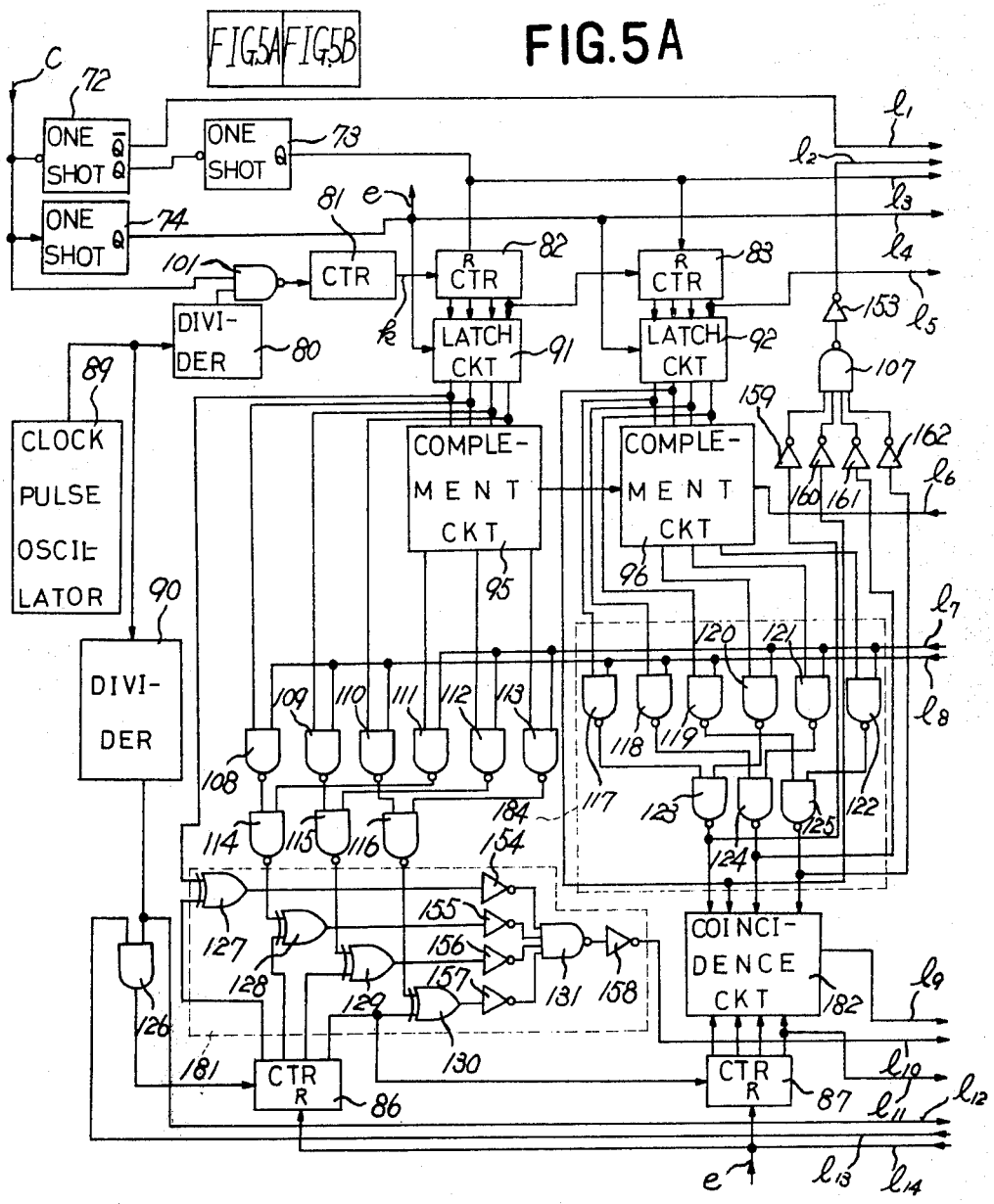
Figure 5B:
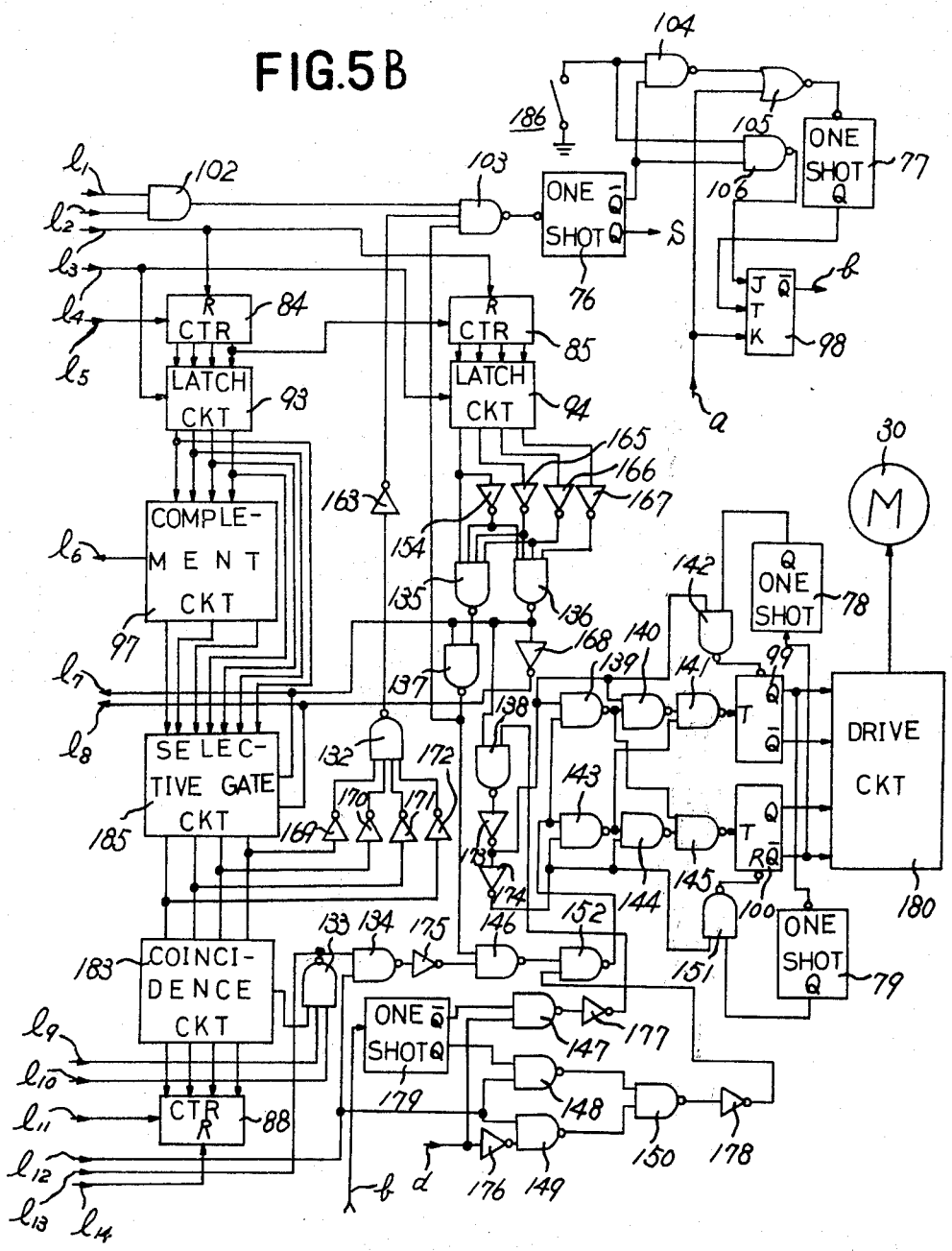

FIG. 4 and FIG. 5A as well as FIG. 5B show an example of a circuit arrangement.

Referring to FIG. 4, D designates a drive circuit for the balance wheel, and E an amplifying and waveform shaping circuit. These circiuts are composed of resistors 46, 47, 48, 49, 50 and 50*a*, a capacitor 51, a D.C. power source 52, a detecting coil 53, a driving coil 54, transistors 55 and 56, a diode 57, and an operational amplifier 58. Numerals 59, 60 and 61 indicate gate circuits, numerals 62 and 63 inverters, and numerals 64 to 67 flip-flop circuits. Shown at 68 is a manual switch. One-shot pulse generators 69, 70 and 71 produce pulses of 30 microseconds, 3 seconds and 0.15 second, respectively.

In FIGS. 5A and 5B, numerals 72 to 79 represent one-shot pulse generators, numeral 80 a divider of frequency of ¼, and numerals 81 to 88 decimal counters. Numeral 89 denotes a clock pulse oscillator for generating clock pulses of 1MHz, while numeral 90 a divider for a frequency division of ½, 500. Numerals 91 to 94 designate latch circuits, numerals 95 to 97 complement circuits of ten, and numerals 98 to 100 flip-flop circuits. Numerals 101 to 152 indicate gate circuits, while numerals 153 to 178 inverters. Shown at 179 is a one-shot pulse generator having the delay function. Shown at 180 is a drive circuit for the motor 30 of the four-phase two-excitation system. Numeral 181 indicates a coincidence circuit, and circuits 182 and 183 are quite similar thereto. Numeral 184 indicates a selective gate circuit, and a circuit 185 is constructed quite similarly thereto. Shown at 186 is a manual switch for resetting.

There will now be explained the operation of the present invention, reference being also had to FIGS. 4, 5A and 5B.

As illustrated in FIG. 1, the hair spring B which has been rolled in the balance wheel A and which is rotatably supported is drawn out, and it is passed between the fixed cutting edge 11 and the movable cutting edge 15 and then held between the driving rollers 26, 27 and the pressed contact rollers 28, 29.

Under this state, the switch 68 shown in FIG. 4 is closed. An output at a terminal *d* is thus brought into a low level, so that an output of the gate circuit 147 in FIG. 5B is inverted into a high level. Therefore, the output of the inverter 177 assumes a low level state, the output of the gate circuit 138 comes to a high level, the output of the inverter 173 comes to a low level, and the output of the inverter 174 comes to a high level. Owing to the high level output of the inverter 174, one input of each of the gate circuits 143, 144 and 151 is held at the high level. On the other hand, an output of the inverter 176 is also held at the high level. In consequence, an output pulse of the divider 90 is supplied through the gate circuit 149 to the gate circuit 150. Since an output Q of the one-shot pulse generator 179 is held at the low level at this time, an output of the gate circuit 148 is held at the high level. Accordingly, the output pulse of the gate circuit 149 is supplied through the gate circuit 150, the inverter 178 and the gate circuit 152 to the gate circuits 139 and 143. As a result, pulses having the same period as that of the output pulse series of the divider 90 are generated at outputs of the gate circuits 141 and 145 at phases opposite to each other. In consequence, in dependence on the phases of the first pulses supplied to the flip-flop circuits 99 and 100, there are generated pulses which shift every ¼ period in outputs Q, $\overline{Q}$ of the flip-flop circuit 99, outputs Q, $\overline{Q}$ of the flip-flop circuit 100 in the converse order.

151 is held at the high level, so that a pulse at an output Q of the one-shot pulse generator 79 as produced by the fall of the output Q of the flip-flop circuit 99 resets the flip-flop circuit 100 through the gate circuit 151. Therefore, the pulses are generated in the latter order at the outputs Q and $\overline{Q}$ of the flip-flop circuits 99 and 100, the drive circuit 180 is actuated to drive the motor 30, and the driving shaft 31 in FIG. 3 is rotated. Thus, the rotary disc 33*a* is rotated, and the rotor 37 lying in frictional engagement therewith is also rotated. Consequently, the pulleys 43 and 44 are rotated, and the driving rollers 26 and 27 are rotated. Owing to the rotations of the driving rollers, the hair spring B is drawn out rightwards as viewed in FIG. 1.

When the hair spring is drawn out to a suitable position, the switch 68 is manually opened. The balance wheel is oscillated by means of the driver circuit D. By opening the switch 68, an output of the inverter 62 is inverted to the low level, and outputs Q and $\overline{Q}$ of the one-shot pulse generator 70 are respectively inverted to the high level and the low level. On the other hand, an output of the driving circuit D is supplied through the amplifying and waveform shaping circuit E to the one-shot pulse generator 69. A pulse having a pulse width of 30 $\mu$s is generated at an output Q of the one-shot pulse generator 69, and is supplied to the gate circuit 59. On the other hand, the high level output of the output Q of the one-shot pulse generator 70 brings an input K of the flip-flop circuit 98 in FIG. 5B into the high level. Further, the high level signal of the output Q of the one-shot pulse generator 70 triggers the one-shot pulse generator 77 through the gate circuit 105 in FIG. 5B and then triggers the flip-flop circuit 98. Thus, an output $\overline{Q}$ of the flip-flop circuit 98 is inverted to the high level. For this reason, an input terminal *b* of the gate circuit 59 shown in FIG. 4 is held at the high level. Since, however, the output $\overline{Q}$ of the one-shot pulse generator 70 is held at the low level, the gate circuit 59 is closed for a set time of the one-shot pulse generator 70 or for three seconds. This is intended to check the output of the one-shot pulse generator 69 from passing for a time enough to stabilize the oscillation of the balance wheel, that is, for 3 seconds in this embodiment. Upon the lapse of 3 seconds, the output $\overline{Q}$ of the one-shot pulse generator 70 is inverted to the high level, the gate circuit 59 is opened, and the output pulse of the one-shot pulse generator 69 is supplied through the gate circuit 59 to the gate circuit 60. Since the one-shot pulse generator 71 is in the reset state, its output Q is at the high level. An output pulse of the gate circuit 59 is supplied through the gate circuit 60 and the inverter 63 to the flip-flop circuit 64 and to the one-shot pulse generator 71. The output $\overline{Q}$ of the one-shot pulse generator 71 is inverted to the low level by the fall of an output pulse of the inverter 63, and closes the gate circuit 60 for 0.15 second.

The reason for the closure of the gate circuit 60 is as stated below. As the hair spring is withdrawn or taken out from the balance wheel by adjusting of oscillation, the relative position between a permanent magnet secured to the balance wheel and a driving and detecting coil for the balance wheel shifts. Due to the shift, the number of times by which the permanent magnet passes through the coil in one period of the oscillation varies. The detection signal of the oscillation period of the balance wheel requires two pulses, and any other unnecessary pulses need be checked from passing. Hereunder this will be explained more in detail.

Figure 6:
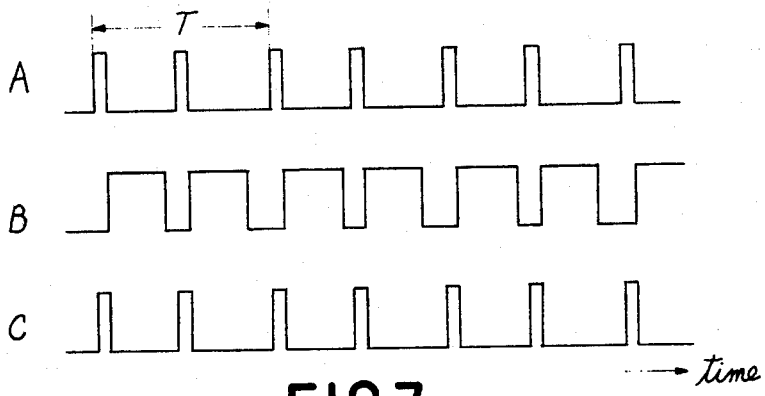
FIGS. 6 to 8 are time charts for explaining the operations of the electronic circuit arrangement.
Figure 7:
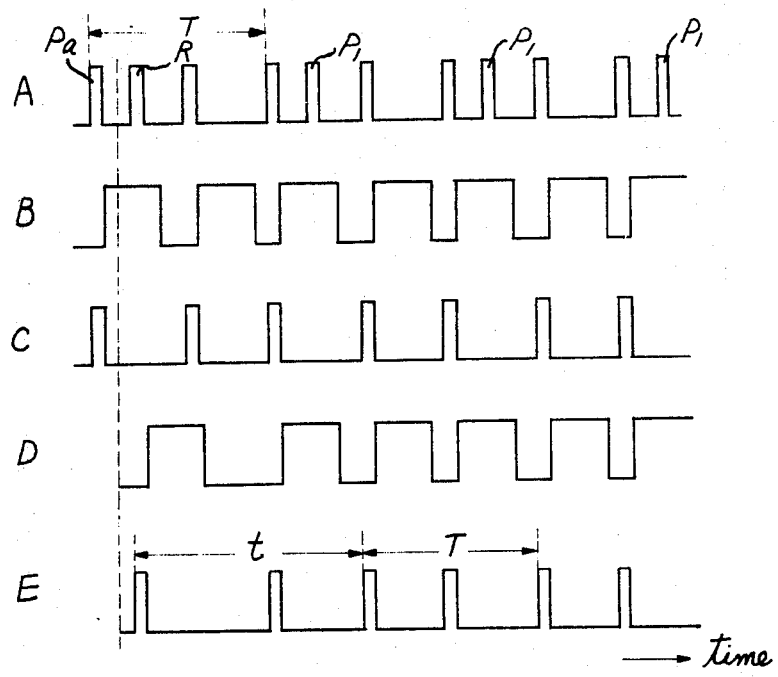

FIGS. 6A, 6B and 6C show the outputs of the one-shot pulse generator 69, the one-shot pulse generator 71 and the inverter 63 in the case where the permanent magnet passes through the coil twice in one period of the oscillation of the balance wheel, respectively. In this case, no unnecessary pulse is generated during one oscillation of the balance wheel. Therefore, the output pulse of the one-shot pulse generator 69 can be supplied through the gate circuit 60 and the inverter 63 to the flip-flop circuit 64 in that condition. FIGS. 7A, 7B and 7C show the outputs of the one-shot pulse generator 69, the one-shot pulse generator 71 and the inverter 63 in the case where the permanent magnet passes through the coil three times in one period T, respectively. In this case, a pulse $P_1$ appears during one oscillation, and it gives rise to a time measuring error. It is checked from passing by a pulse shown in FIG. 7B, so that two pulses are generated in one period T at the output of the inverter 63 shown in FIG. 4. FIGS. 7D and 7E illustrate the respective outputs of the one-shot pulse generator 71 and the inverter 63 at the time when the one-shot pulse generator 70 operates immediately after the pulse $P_a$ in FIG. 7A is generated. As shown in FIG. 7E, the interval $t$ of the first three pulses differs from the oscillation period T, but the subsequent pulses are generated at the normal period.

Figure 8:
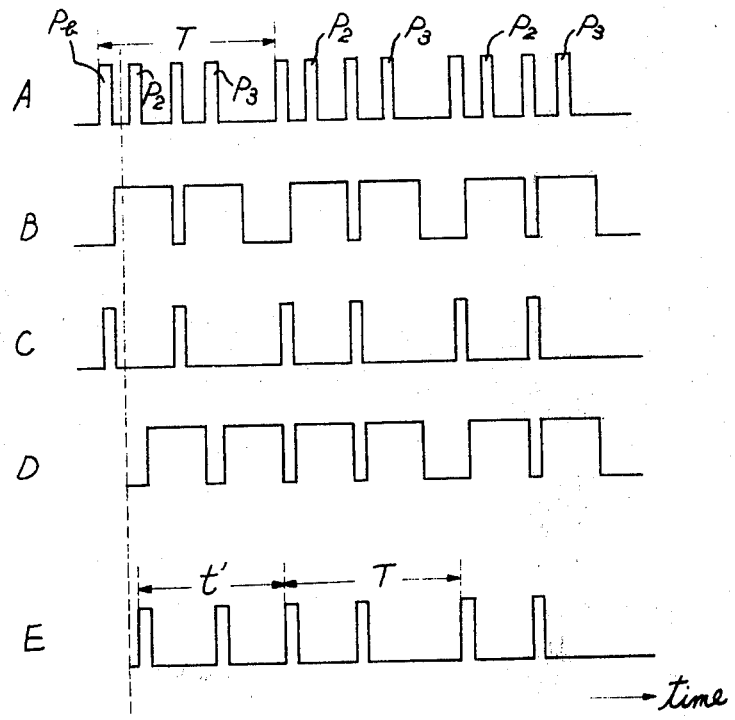

FIGS. 8A to 8E illustrate a case where the magnet passes through the coil four times in one period T. Among the output pulses of the one-shot pulse generator 69 as shown in FIG. 8A, those pulses $P_2$ and $P_3$ are unnecessary. The passage of the pulses $P_2$ and $P_3$ is checked by the output Q of the one-shot pulse generator 71 shown in FIG. 4. Accordingly, the pulses appear as shown in FIG. 8C at the output of the inverter 63. FIGS. 8D and 8E illustrate the respective outputs of the one-shot pulse generator 71 and the inverter 63 at the time when the one-shot pulse generator 70 operates immediately after the pulse $P_b$ in FIG. 8A is produced. Also in this case, the time interval $t'$ of the first three pulses differs from the period T, but the subsequent pulses are generated at the normal period.

As stated above, although the number of times by which the permanent magnet passes through the coil varies in dependence on the oscillation position of the balance wheel, the gate circuit 60 is controlled by the output of the one-shot pulse generator 71 so as to check the unnecessary pulses from passing. As a result, the flip-flop circuit 64 is supplied with only two pulses within one period of the vibration of the balance wheel, and the vibration period of the balance wheel is discriminated by the pulses. Accordingly, the pulses whose period is equal to the period T of the oscillation of the balance wheel appear at the output $\overline{Q}$ of the flip-flop circuit 64. These pulses are sequentially subjected to frequency divisions by the succeeding flip-flop circuits 65, 66 and 67. In consequence, pulses whose period is equal to eight periods of the vibration of the balance wheel and whose pulse width is equal to the period T of the vibration of the balance wheel are generated at an output terminal C of the gate circuit 61. Those pulses are supplied to the one-shot pulse generators 72 and 74 and the gate circuit 101 shown in FIG. 5A. Pulses are therefore generated at the respective outputs $\overline{Q}$ and Q of the one-shot pulse generators 72 and 74. On the other hand, clock pulses at 250KHz from the divider 80 are supplied through the gate circuit 101 to the counter 81 during the appearance of the pulses at the output terminal C of the gate circuit 61 shown in FIG. 4, that is, during one period T of the oscillation of the balance wheel. Accordingly, when the one period of the balance wheel before adjusting is longer than 0.4 second, since the daily rate thereof is within 6,000 seconds, 100,000 through 106,000 pulses pass through the gate circuit 101, and the contents of the counter 85 count zero. When the one period of the balance wheel is shorter than 0.4 second, number to at most 99,999 pulses through the gate circuit 101, and the contents of the counter 85 count nine.

Description will be first made of the case where the one period of the balance wheel is longer than 0.4 second. The counters 82, 83 and 84 count the second, third and fourth digits, respectively. The contents of the counter 85 at the fifth digit are 0 as stated above. The count value 0 of the counter 85 brings all inputs of the gate circuit 136 into high levels through the latch circuit 94 and the inverters 154, 165, 166 and 167, so that an output of the gate circuit 136 becomes the low level. The output of the inverter 168 therefore assumes the high level and selects the gate circuits 108, 109 and 110, those 117, 118 and 119 and similar gate circuits in the selective gate circuit 185. After the pulses having passed through the gate circuit 101 during one period T of the oscillation of the balance wheel are counted by the counters 82 – 85, the count contents of the counters 82 – 85 are stored into the respective latch circuits 91 – 94 by the fall of the pulse of the one-shot pulse generator 74. Simultaneously therewith, the counters 86, 87 and 88 in FIGS. 5A and 5B are reset through a terminal $e$. The stored contents of the latch circuits 91, 92 and 93 are respectively supplied to the coincidence circuits 181, 182 and 183 through the gate circuits 108, 109, 110, 114, 115 and 116, the gate circuits 117, 118, 119, 123, 124 and 125 and the selective gate circuit 185. The stored contents of the latch circuits 91, 92 and 93 differ from the count contents of the counters 86, 87 and 88, that is, 0, and hence, outputs of the coincidence circuits 181, 182 and 183 are held in the state of the low level. Therefore, the output of the gate circuit 133 is held at the high level and opens the gate circuit 126 as well as the gate circuit 134. Accordingly, the output pulses of the divider 90 are supplied through the gate circuit 126 to the counter 86, and the counters 86, 87 and 88 commence counting. The output pulses of the divider 90 are simultaneously supplied through the gate circuit 134 and the inverter 175 to the gate circuit 146. Since, as previously stated, the output of the gate circuit 136 is at the low level, an output of the gate circuit 137 is held at the high level and one input of the gate circuit 146 is held at the high level. Accordingly, an output pulse of the inverter 175 is supplied through the gate circuit 146 to the gate circuit 152.

On the other hand, the terminal *d* shown in FIG. 4 is held at the high level, so that the output of the inverter 176 shown in FIG. 5B is held at the low level and that the output of the gate circuit 149 is held at the high level. Since the output of the gate circuit 148 is also held at the high level, the output of the gate circuit 150 is held at the low level and that of the inverter 178 at the high level. Consequently, the pulse from the gate circuit 146 is supplied through the gate circuit 152 to the gate circuit 139 and to the gate circuit 143. Since, at this time, the output Q of the one-shot pule generator 179 and the terminal *d* are held at the high level, the output of the gate circuit 147 is held at the low level and that of the inverter 177 at the high level. Since the output of the gate circuit 136 is at the low level, the output of the gate circuit 138 becomes the high level, and the output of the inverter 173 becomes the low level and accordingly holds one input of the gate circuit 139 at the low level. Therefore, one input of the gate circuit 139 is held at the low level, while one input of the gate circuit 143 is held at the high level. The drive circuit 180 is actuated in the same way as in the foregoing by the pulse from the gate circuit 146, the motor 30 is driven, and the hair spring B is taken out from the balance wheel.

When the counting of the counters 86, 87 and 88 proceeds and the count contents thereof coincide with the stored contents of the latch circuits 91, 92 and 93, all the outputs of the coincidence circuits 181, 182 and 183 become the high level and the output of the gate circuit 133 is inverted to the low level. The gate circuit 126 and the gate circuit 134 are therefore closed. Consequently, the motor 30 is stopped, and the taking out of the hair spring ends. Thereafter, the pulse from the output Q of the one-shot pulse generator 72 falls. A pulse is generated from an output Q of the one-shot pulse generator 73, and the counters 82 – 85 are reset by the fall of the pulse. Thereafter, a pulse due to the oscillation of the balance wheel with the hair spring taken out as described above is supplied from the gate circuit 61 in FIG. 4 to the terminal *c* in FIG. 5A. The same operation as stated above is repeated. By the repetition of the operation, the length of the hair spring is gradually adjusted. The counters 81 – 85 count the output pulses of the divider 80. When the count contents of the counters 83 and 84 become 0, all the outputs of the inverters 159 – 162 and the inverters 169 – 172 assume the high level, and the outputs of the gate circuits 107 and 132 assume the low level. The outputs of the inverters 153 and 163 are therefore held at the high level. Since the output of the gate circuit 136 is at the low level as previously stated, the output of the gate circuit 137 is at the high level and two inputs of the gate circuit 103 are held at the high level. On the other hand, the output $\overline{Q}$ of the one-shot pulse generator 72 is inverted to the high level after the inversion of the outputs of the coincidence circuits 181, 182 and 183 to the high level and the stop of the motor 30. Thus, an output of the gate circuit 102 is inverted to the high level, and all the inputs of the gate circuit 103 come to the high level. An output of the gate circuit 103 is accordingly inverted to the low level. Thus, outputs Q and $\overline{Q}$ of the one-shot pulse generator 76 are respectively inverted to the high level and the low level. Upon the inversion of the level of the output Q, the rotary solenoid 1 shown in FIG. 1 is driven. Therefore, the driving lever 2 rocks clockwise, and the turning effort rocks the swivel lever 7 counterclockwise through the coupling pieces 3, 5 and 6. In consequence, the slide plate 16 descends, and the hair spring B is cut by the movable cutting edge 15 and the fixed cutting edge 11. Simultaneously therewith, the hair spring B is bent by the inclined plane 21 and the inclined side 22. As is well known, the bending portion is mounted at an end of a stud by a wedge. The oscillation period of the balance wheel is detected while the hair spring is being taken out so that the center of oscillation shifts. In addition, the short-time stability of the balance wheel is not good, so that an error arises. The count contents of the counter 82 lie within an allowable range. On the other hand, in consequence of the inversion of the level of the output $\overline{Q}$ of the one-shot pulse generator 76 in FIG. 5B, the output of the gate circuit 104 is inverted to the high level, and the output of the gate circuit 105 is inverted to the low level. Thus, a pulse is generated at the output Q of the one-shot pulse generator 77. The fall of this pulse triggers the flip-flop circuit 98 and inverts its output $\overline{Q}$ to the low level. Therefore, the input terminal *b* of the gate circuit 59 shown in FIG. 4 is held at the low level, and the output pulse from the one-shot pulse generator 69 is blocked by the gate circuit 59. In consequence of the inversion of the level of the output $\overline{Q}$ of the flip-flop circuit 98, the outputs Q and $\overline{Q}$ of the one-shot pulse generator 179 are respectively inverted to the high level and the low level with a delay of a time enough to complete the cutting of the hair spring or 0.3 second in this embodiment. The output pulse of the divider 90 is therefore supplied to the gate circuits 139 and 143 through the gate circuits 148 and 150, the inverter 178 and the gate circuit 152. At this time, the output of the gate circuit 147 is at the high level. In consequence, the output of the inverter 177 is held at the low level, that of the gate circuit 138 at the high level, and that of the inverter 174 at the high level. Accordingly, the drive circuit 180 is actuated in the same way as in the foregoing by the output pulse of the gate circuit 152. The motor 30 is driven, and the cut part of the hair spring is fed out and thrown away.

Description will now be made of the case where the one period of the balance wheel is shorter than 0.4 second. In this case, the one-shot pulse generators 72 and 74 are operated similarly to the foregoing by the pulse generated at the terminal *c*, the gate circuit 101 is opened, and the counters 81 – 85 commence counting. Since the number of pulses to pass through the gate 101 is 99,999 at the maximum, the count contents of the counter 85 becomes 9. As in the previous explanation, the counters 86, 87 and 88 begin counting after the count contents of the counters 82 – 85 are stored into the latch circuits 91 – 94 by the fall of the output pulse of the one-shot pulse generator 74. Since the stored contents of the latch circuit 94 are 9 and two of the four outputs thereof assume a high state level, the output of the gate circuit 136 comes to high level and the output of the inverter 168 comes to low level. Therefore, the gate circuits 111, 112 and 113, those 120, 121 and 122 and similar gate circuits in the selective gate circuit 185 are selected. Outputs of the complement circuits 95, 96 and 97 are respectively supplied to the coincidence circuits 181, 182 and 183 through the gate circuits 111, 112, 113, 114, 115 and 116, the gate circuits 120, 121, 122, 123, 124 and 125 and the selective gate circuit 185.

The value counted by the counters 82 – 85 is not a difference from the reference value 100,000. In order to know the difference, it is necessary to subtract the count value of the counters 82 – 85 from the reference value. For this reason, the complements of ten for the respective count contents of the counters 82 – 84 are taken to evaluate deviations, which are supplied to the coincidence circuits 181, 182 and 183. The output of the gate circuit 138 is at low level, that of the inverter 173 is at the high level, and that of the inverter 174 is at the low level. Therefore, conversely to the foregoing case where the one period is longer than 0.4 second, the inputs of the gate circuits 143 and 144 are held at the low level and the inputs of the gate circuits 139, 140 and 142 are held at the high level. In the order reverse to that in the foregoing case, pulses whose phases shift every ¼ period are produced at the outputs Q and $\overline{Q}$ of the flip-flop circuits 99 and 100. The drive circuit 180 is actuated to rotate the motor 30 in the direction opposite to that in the foregoing case and to rewind the hair spring. The subsequent operation is conducted as in the previous explanation.

Assuming that the allowable range of the error of the balance wheel after the adjustment may be somewhat widened in comparison with the same in the embodiment stated above, the circuit arrangement is simplified by employing circuits to be now described instead of the complement circuits 95, 96 and 97.

Figure 9:
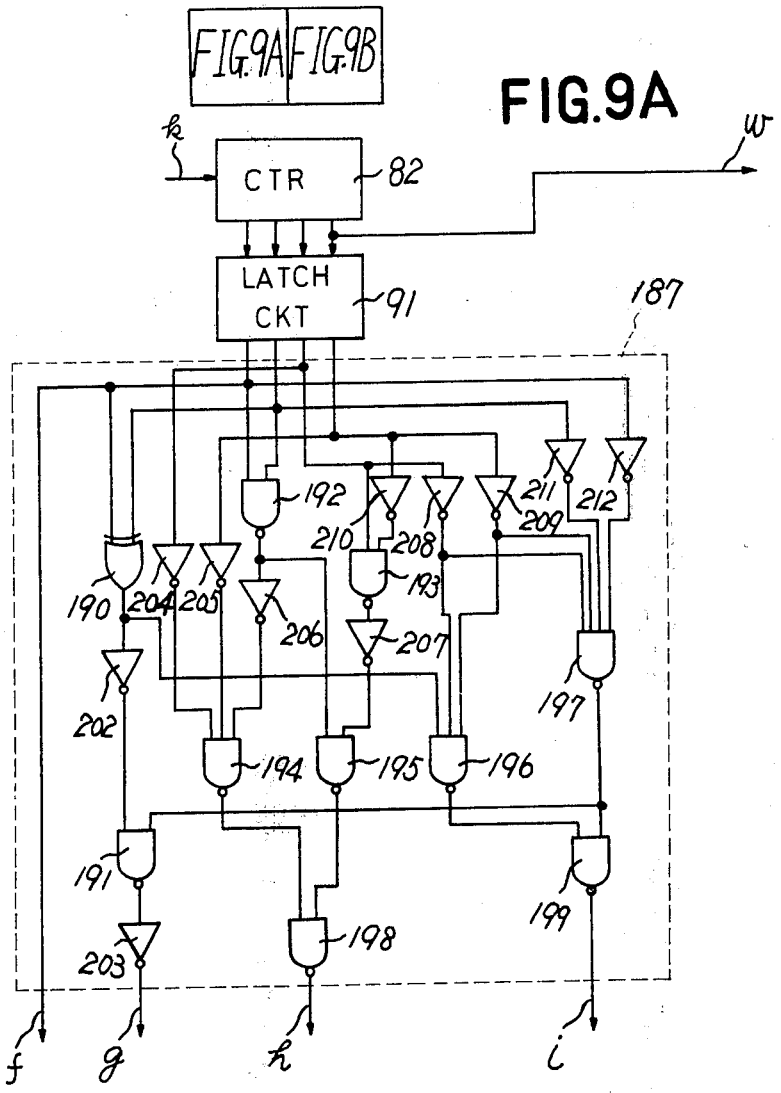
FIGS. 9A and 9B are diagrams of electronic circuits which may be used instead of parts of the electronic circuit arrangement.
Figure 9B:
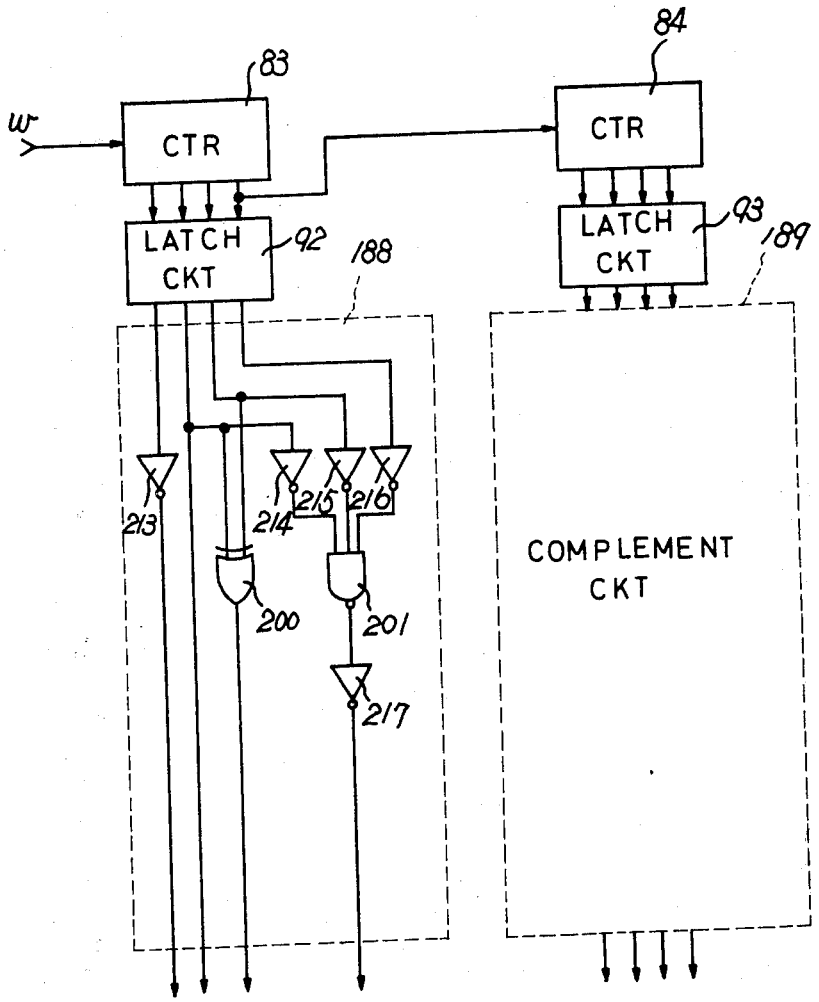

Referring to FIGS. 9A to 9B, numerals 187 and 188 designate complement circuits which take complements of 10 and 9, respectively. A circuit 189 is quite similar to the complement circuit 188. Numerals 190 – 201 indicate gate circuits, and numerals 202 – 217 inverters. The same symbols as in FIGS. 5A and 5B denote the same parts.

With the circuit arrangement stated above, when the count contents of the counter 82 are not 0, the complements of correct values are generated at outputs of the complement circuits 187 and 189. When the count contents of the counter 82 are 0, all output terminals *f*, *g*, *h* and *i* of the complement circuit 187 come to the low level, and 0 is produced. On the other hand, the complement of 9 for the count contents of the cunter 83 is generated at the complement circuit 188. The complement of 9 is taken in consideration of a borrow component from the complement circuit 187 at the preceding stage. In this case, however, there is no borrow from the complement circuit 187. Correctly, therefore, the complement of 10 ought to be generated, where the count contents of the counter 82 become 0, the output of the complement circuit 188 becomes 8. For this reason, a value resulting by subtracting 20 from an error value is generated.

As stated above in detail, the present invention puts the whole measuring apparatus into electronic circuitry. Therefore, it is extremely small in size and can be freely carried to a suitable place. Moreover, it is not required that an operator watch the cutting of the hair spring each time. Therefore, the operation efficiency is high.

I claim:

1. Apparatus for adjusting the frequency of an oscillating element provided with a hair spring comprising: a converter circuit which converts into predetermined signal pulses an oscillating output signal of said oscillating element having its oscillation period determined by said hair spring, a first control circuit which controls passage of clock pulses by the output pulses of said converter circuit, a first counter which counts the clock pulses having passed through said first control circuit, a second control circuit which controls passage of reference pulses, a second counter which counts the reference pulses having passed through said second control circuit, a coincidence circuit which detects coincidence between count contents of said first counter and said second counter, first means to control said second control circuit by the coincidence output and to check said reference pulses to said second counter, and mechanical means to transport said hair spring during the counting operation of said second counter and to cut an unnecessary part of said hair spring after said first counter has counted a predetermined value.

2. The apparatus according to claim 1, wherein said mechanical means comprises a motor, means driven by said motor to transport said hair spring, cutting means to cut said unnecessary part of said hair spring, and driving means to actuate said cutting means.

* * * * *